US006668699B2

(12) United States Patent
Russell

(10) Patent No.: US 6,668,699 B2
(45) Date of Patent: Dec. 30, 2003

(54) POROUS NOZZLE PROJECTILE BARREL

(76) Inventor: Ronnie David Russell, 3330 Mary La., Dickinson, TX (US) 77539

( * ) Notice: Subject to any disclaimer, the term of this patent is extended or adjusted under 35 U.S.C. 154(b) by 0 days.

(21) Appl. No.: 10/068,037

(22) Filed: Feb. 5, 2002

(65) Prior Publication Data

US 2002/0100361 A1 Aug. 1, 2002

Related U.S. Application Data

(63) Continuation-in-part of application No. 09/460,088, filed on Dec. 14, 1999, now abandoned, which is a continuation-in-part of application No. 09/137,544, filed on Aug. 20, 1998, now Pat. No. 6,089,139.

(51) Int. Cl.[7] ..... F41A 21/16
(52) U.S. Cl. ..... 89/14.05; 89/14.3; 89/8
(58) Field of Search ..... 89/14.05, 8, 14.3; 42/76.01

(56) References Cited

U.S. PATENT DOCUMENTS 4,429,612 A * 2/1984 Tidman et al.
4,590,842 A * 5/1986 Goldstein et al.
4,722,261 A * 2/1988 Titus
5,012,720 A * 5/1991 Tidman
5,050,478 A * 9/1991 Juston
5,119,716 A * 6/1992 Bartolles
5,233,903 A * 8/1993 Saphier
5,322,002 A * 6/1994 Miskelly, Jr. et al.
5,386,759 A * 2/1995 Onozuka et al.
5,841,058 A * 11/1998 Manis
6,308,609 B1 * 10/2001 Davies

* cited by examiner

*Primary Examiner*—Peter M. Poon
*Assistant Examiner*—Troy Chambers
(74) *Attorney, Agent, or Firm*—John R Casperson

(57) ABSTRACT

A porous barrel, projectile passageway, or tube as a type of supersonic nozzle for projectile propulsion therein and method for optimizing projectile velocity therethrough. The porous barrel features a barrel wall containing holes, passageways, or otherwise porous material through the barrel wall that allows gas, fluid, or other matter to exit or move in a direction away from the barrel interior. The flow of gas, fluid, or other matter away from the barrel interior allows gas within the barrel to expand in a direction transverse to the projectile path. The amount of transverse expansion of the gas in the barrel interior can be controlled by the porosity of the barrel wall to cause any desired amount of gas expansion. Transverse expansion allows axial gas velocities within the barrel to exceed the local speed of sound as if the gas had passed through a converging diverging nozzle. In one embodiment, a pressurized gas source supplies a pressure propelling the projectile through a gun barrel, and gas outflow from passageways through the barrel wall allows gas within the barrel, as well as the projectile, to obtain supersonic velocities as the gas and projectile accelerate.

4 Claims, 1 Drawing Sheet

POROUS NOZZLE PROJECTILE BARREL

CROSS-REFERENCES TO RELATED APPLICATIONS

This application is a continuation in part of my copending application Ser. No. 09/460,088, filed Dec. 14, 1999, now abandoned, which was a continuation in part of my then copending application Ser. No. 09/137,544 filed Aug. 20, 1998, now U.S. Pat. No. 6,089,139, issued Jul. 18, 2000.

FIELD OF THE INVENTION

This invention relates to any form of projectile launcher or gun which utilizes gas, plasma, explosive, or any compressible material to drive or propel a projectile. In one embodiment, this invention relates to projectile accelerators such as airguns, hypervelocity guns, and high velocity projectile launchers in which it is desired or beneficial to obtain a projectile velocity that is greater than the local speed of sound of the driving gas or compressible substance.

BACKGROUND OF THE INVENTION

Early documentation of compressible gas powered projectile propulsion devices, such as airguns, dates back to around the middle of the 16th century according to Traister, Robert J, 1981, *All About Airguns,* Tab Books Inc., Blueridge Summit, Pa. These ancient airguns were generally military devices used to fire projectiles in the .30 to .60 caliber size range. They were usually pneumatic, having a pressure cylinder that was manually pressurized. The basic principles used in gas powered guns have changed only slightly over the years.

Gas driven guns now have a wide variety of applications. Low velocity sport airguns are commonly used for target practice, gun training, and for hunting very small game. Airgun competition is now an Olympic sport. Airguns are also used in military and science labs for various purposes. The military uses airguns to launch some types of missiles which have vibration sensitive electronics inside according to Jones, M. C., 1986, "Shock Simulation and Testing in Weapons Development," *The Journal of Environmental Sciences,* September/October, Vol. 29, pp. 17–21. Gas powered guns are also used in various types of field weapons. Airguns typically operate with low vibration compared to explosive driven guns. Gas powered guns also are typically more controllable than explosive powered guns. Hypervelocity guns are similar to airguns, but usually use explosives and high temperature light gases which have a high speed of sound to achieve much higher velocities.

Airguns today are generally low powered and low velocity compared to guns which use explosives or high temperature light gases to drive the projectile. The most significant factor in the low velocity limitation of airguns and low temperature compressible gas powered guns is the speed of sound in the driving gas that propels the projectile. However, hypervelocity guns that use explosives, hot gasses, light gasses, plasma, and other gas like propellants are also limited by the same principle. For example, compressible gas equations for a gas in steady state, isentropic flow show that gas traveling from a high pressure reservoir at rest, to a low pressure reservoir, through a constant area or narrowing passageway, cannot exceed the velocity of the local speed of sound. The assumption of isentropic flow is common practice for many airgun designers. Using a hydraulic analogy of an airgun shows that even though an airgun is an unsteady device, the sonic limitation still applies.

Efforts to minimize the effect of the sonic velocity limitation have led to developments such as "light gas guns" as disclosed in U.S. Pat. No. 3,186,304 and mentioned in U.S. Pat. No. 5,303,633. Light gasses, such as hydrogen, have a high speed of sound and increase the attainable sonic velocity. For example, the speed of sound in hydrogen is about 4 times faster than the speed of sound in air at the same temperature.

Raising the temperature of the driving gas is another way to reduce the effect of the sonic velocity limit. Raising the temperature of a gas raises the speed of sound in the gas. Several methods that raise the temperature of the propellant gas immediately before firing a gun are used today. For example, in U.S. Pat. No. 3,311,020 a conventional piston compresses the propellant gas immediately before firing the gun raising the temperature very high. In U.S. Pat. No. 3,465,638 an explosion compresses the driving gas chamber increasing the temperature of the driving gas and thus raises its speed of sound. Many similar methods of adding heat to the driving gas have been used to raise the speed of sound of the driving gas; however, they are all nonetheless limited by the sonic limitation.

Similarly, U.S. Pat. No. 4,658,699 discloses a wave gun that uses an explosive to propel a piston which compresses the driving gas chamber. Rapid acceleration of the piston creates shock waves ahead of the piston which raise the pressure and temperature of the driving gas. This gun is also mentioned in U.S. Pat. No. 5,303,633 which attempts to improve upon the above mentioned technology. Again, the gas upstream from the projectile is limited by the sonic limitation.

U.S. Pat. No. 5,303,633 discloses a "shock compression jet gun" that implements a shaped charge, compressible gas, and converging-diverging nozzle to drive a projectile through a barrel. The explosive shaped charge provides high pressure and temperature gas upon detonation. Then the high temperature and pressure exhaust gasses accelerate through a converging-diverging supersonic nozzle. Upon exiting the nozzle, the supersonic driving gasses, preceded by an abrupt normal shock, hit the projectile. The normal shock rebounds from the projectile leaving higher temperature and pressure subsonic gas immediately behind the projectile. This high temperature gas immediately behind the projectile remains limited to sonic velocities as the projectile travels through the barrel.

The above mentioned gun types are dynamic devices, and the sonic limitation as applied to them should be clarified. Upon firing a gas powered gun, local flow properties such as Mach number, temperature, and pressure will vary with time and position within the gun because firing a gun is an unsteady process. Under some circumstances, the projectile velocity could be greater than the local speed of sound of the gas immediately behind the projectile in the above mentioned gun types. For example, if the gas temperature behind the projectile decreases as the projectile travels, the local speed of sound in the gas behind the projectile may lower to a value that is less than the velocity of the projectile. However, in this example, the projectile never exceeds the maximum local speed of sound attained in the driving gas immediately behind the projectile along its pathway through the barrel. Therefore, without the use of some type of supersonic projectile barrel, as herein described, the projectile velocity cannot exceed the maximum transient sonic velocity of the driving gas behind the projectile.

In the case of the "shock compression jet gun" in U.S. Pat. No. 5,303,633, the velocity of the projectile is also limited by the local speed of sound immediately behind the projectile. Combustion gasses may attain a supersonic velocity after passing through the converging-diverging nozzle. However, supersonic explosion gasses hitting the projectile will cause a normal shock to rebound from the projectile. Once a normal shock rebounds from the projectile, the gas immediately behind the projectile is high temperature and pressure, but is subsonic, and travels the same velocity that the projectile travels. The temperature rise after the shock wave from the driving gas hits the projectile will increase the speed of sound in the gas immediately behind the projectile to higher values. This increased temperature raises the limiting speed of sound. However, this method is also limited by the speed of sound in the driving gas as mentioned and clarified above.

U.S. Pat. No. 4,590,842 discloses a "Method of and Apparatus for Accelerating a Projectile" that places multiple supersonic plasma spray nozzles along the projectile barrel that spray supersonic plasma through the barrel wall and against the back of the projectile as it passes each nozzle. FIG. 2 in this patent depicts supersonic plasma spray from the nozzle impacting the back side of the moving projectile which causes the supersonic plasma to slow down and create shock waves. This patent explains that the barrel is designed to fit loosely around the projectile at locations where projectile velocity is high to minimize friction. This loose barrel to projectile fit allows high pressure plasma from the back of the projectile to escape into the region in front of the projectile through the annular gap between the barrel and projectile. Apertures, or vents, may be placed in the barrel wall downstream from a plasma spray nozzle to vent plasma gasses that accumulate in front of the projectile. In this design, the projectile may reach speeds that are greater than the speed of sound of the driving gas because of the multiple impacts of supersonic driving gas against the projectile accelerating the projectile in multiple stages along its path through the barrel.

The above patent, U.S. Pat. No. 4,590,842, discloses that the purpose and design of the apertures, or vents, is to remove high pressure plasma that had accumulated in front of the projectile. The patent never indicates or claims that the apertures are designed to vent or control the gas behind the projectile. The patent also recommends a preferred size of aperture having a cross sectional area equal to approximately twice the barrel, or projectile, cross sectional area.

With the exception of the design disclosed in U.S. Pat. No. 4,590,842, the problem in all the above types of guns which use any type of compressible gas to accelerate the projectile is that the attainable projectile velocity is restricted by the speed of sound in the driving gas or gasses behind the projectile. Projectile velocity in the design disclosed in U.S. Pat. No. 4,590,842 is not limited by the speed of sound in the driving gas because of its modular supersonic plasma jets that repeatedly impact the projectile as it travels along the length of the barrel. The present invention allows driving gas propelling the projectile and the projectile itself to reach supersonic velocities without the complexity and cost of methods such as the one disclosed in U.S. Pat. No. 4,590,842.

SUMMARY OF THE INVENTION

A purpose of the present invention is to eliminate the sonic velocity limitation of gas driven guns which propel a projectile through a barrel or tube, thereby increasing the attainable projectile velocity. Another purpose of the present invention is to provide a method of controlling the local Mach number of the driving gasses along their travel through any variety of projectile barrel or tube. The driving gasses can be pressurized gas, explosive combustion products, or any gas-like substance.

In one embodiment of the invention, a projectile is driven through the barrel of a gun by a driving gas. There is provided a process to drive the projectile at supersonic velocities with the driving gas. The driving gas is employed to push the projectile through a first portion of a barrel until the projectile reaches a speed equal to the speed of sound in the driving gas at a location immediately behind the projectile. Portions of the driving gas are then bled off from behind the projectile at locations spaced along a second portion of the barrel in a manner to further accelerate the projectile.

In another embodiment, a projectile is accelerated along a tube using compressed gas as the motive force until the projectile reaches a velocity equal to the speed of sound, based on the speed of sound in the compressed gas immediately behind the projectile. Portions of the compressed gas are then vented off through the wall of the tube from locations behind the projectile, thereby providing transverse expansion of the compressed gas and further acceleration of the projectile.

In another embodiment of the invention, there is provided apparatus which can be employed to carry out the just described processes.

In one manifestation, a nozzle projectile barrel comprises a barrel wall extending from a breech end to a muzzle end. The barrel wall defines a main projectile passageway to permit the passage of a projectile driven by a driving gas therethrough. The barrel wall has a plurality of longitudinally spaced apart transverse passageways positioned in a region of the barrel between a point where the driving gas immediately behind the projectile achieves local Mach 1 and the muzzle end of the barrel wall. Local gas mass flow from the main projectile passageway through the longitudinally spaced apart transverse passageways causes supersonic driving gas flow with respect to the speed of sound in the driving gas within the nozzle projectile barrel.

In another manifestation, the nozzle projectile barrel comprises a barrel wall which defines a main projectile passageway and a plurality of longitudinally spaced apart transverse passageways. The barrel wall extends from a breech end to a muzzle end. The main projectile passageway is for the passage of a projectile driven by a driving gas. The plurality of longitudinally spaced apart transverse passageways are positioned in a region of the barrel wall between a point where the driving gas immediately behind the projectile achieves local Mach 1 and the muzzle end of the barrel wall. The transverse passageways have a size restricting driving gas outflow from the main projectile passageway to a mass flow rate causing the driving gas behind the projectile to expand in a direction transverse to the projectile velocity at a rate causing the driving gas to accelerate to supersonic velocities for accelerating the projectile to supersonic speed relative to the speed of sound in the driving gas.

In a further manifestation, an apparatus comprises a barrel, a projectile and a driving gas pressure source. The barrel is formed by a barrel wall and has a breech end and a muzzle end. The barrel wall defines a passage extending from the breech end to the muzzle end. The projectile has a cross section which closely matches the cross section of the passage. The projectile is positioned in the passage in sealing engagement with the barrel wall. The driving gas pressure source is connected to the breech end of the barrel, and the driving gas pressure source has a sufficiently high pressure to accelerate the projectile to local Mach 1 in the barrel. The barrel wall has a solid region extending from the breech end toward the muzzle end and a porous region extending from the muzzle end toward the breech end. The porous region is sufficiently permeable to the driving gas so that transverse expansion of the driving gas through the wall of the tube permits the driving gas to achieve supersonic flow as if the driving gas had passed through a diverging nozzle.

The porous nozzle projectile barrel of the present invention offers the simplicity of conventional gun technology but eliminates the sonic driving gas limitation and thereby improves the performance of existing conventional guns. Further, the ease of modifying conventional guns of nearly any type to implement a porous nozzle projectile barrel provides easy incorporation into nearly all current gun applications. The passageways through the barrel wall have an additional benefit of allowing gas in front of the projectile to escape from the barrel interior through barrel wall passageways, thereby decreasing the gas pressure in front of the projectile and increasing the projectile velocity.

Furthermore, the porous nozzle projectile barrel may be used with any type of propellant that provides or produces pressurized gas to drive a projectile through a barrel. The propellant may include gun powder or other explosives commonly used in rifles today, or static or spring-compressed gas as is used in airguns. The propellant or driving gas source may also include plasma, chemical reaction products, or any other substance that has physical properties similar to a gas.

BRIEF DESCRIPTION OF THE DRAWINGS

The present invention will be more fully understood from the detailed description given hereinbelow and the accompanying drawings which are given by way of illustration only, and thus are not limiting of the present invention, and wherein.

DETAILED DESCRIPTION OF THE INVENTION

Figure 1:
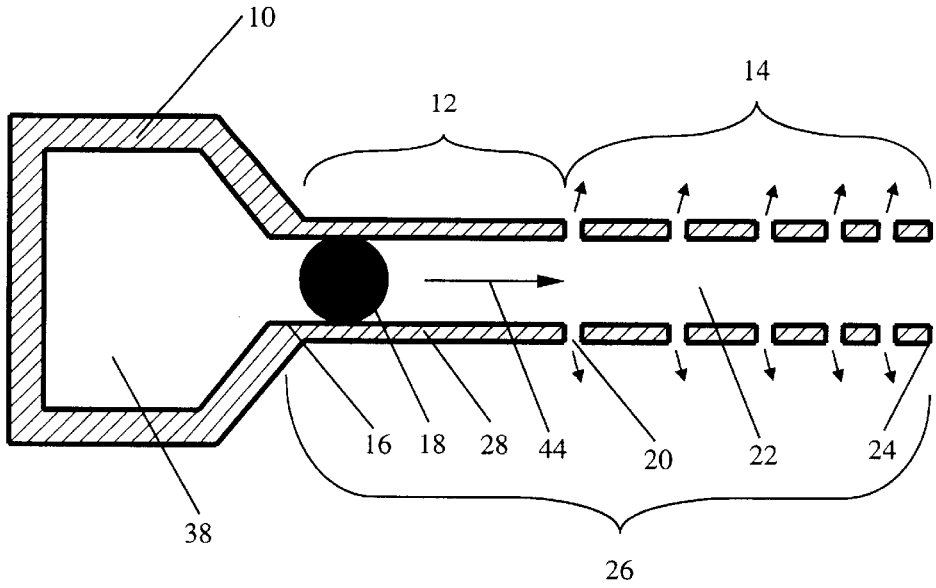
FIG. 1 shows a cross sectional view of one embodiment of the porous nozzle projectile barrel with a gas pressure chamber and projectile shown at rest before firing the gun.

The present invention comprises using a barrel or projectile launch tube which has holes, vents, passageways, or other means of porosity through the barrel wall which allow gas to exit or enter the barrel interior through the barrel wall. Gas exiting from the barrel interior through barrel wall passageways allows gas within the barrel interior to expand transverse to the direction of projectile motion. This transverse expansion of the gas in the barrel interior has the same effect on gas flow that a diverging nozzle has on gas flow. Gas in the barrel interior can accelerate to supersonic velocities if gas traveling at Mach 1 or faster passes through a porous barrel that allows gas to exit from the barrel interior through barrel wall passageways. Gas within the barrel will slow down if gas traveling less than Mach 1 passes through a porous barrel that allows gas to exit the barrel interior through barrel wall passageways. Gas entering the barrel interior through passageways causes subsonic gas in the barrel interior to accelerate, and causes supersonic gas in the barrel interior to decelerate.

In this invention, porosity using any type of passageway or duct through a gun barrel wall can be placed strategically along the barrel to control pressure and Mach number of gas within the barrel along the projectile pathway. In general, adding gas exit passageways through the barrel wall at locations where subsonic gas velocity would otherwise be expected in the barrel interior as the projectile passes will reduce the driving gas pressure, velocity, and Mach number. Adding gas exit passageways through the barrel wall where sonic or supersonic gas is traveling through the barrel interior can increase the velocity and Mach number of gas in the barrel interior. Adding gas entrance passageways through the barrel wall which add gas to the barrel interior has the opposite effect. Adding gas entrance passageways through the barrel wall accelerates subsonic flow and decelerates supersonic flow through the barrel interior. Without a method of allowing gas to expand transverse to the flow direction, the projectile and driving gasses could not continue to accelerate once sonic velocity is reached.

In the case of adding oversized passageways through a barrel wall at a location where sonic or supersonic projectile and driving gas velocity is expected in the barrel interior, gas exiting from the barrel interior through passageways may cause driving gas to accelerate faster than the projectile. This accelerating driving gas can impact the projectile, causing shock waves to develop behind the projectile which may reduce the driving gas Mach number immediately behind the projectile to subsonic. The pressure of this subsonic gas may be higher than the pressure of the supersonic gas, but its contribution to projectile acceleration is likely short lived and could prevent additional acceleration of the supersonic projectile. A conclusion from the above considerations is that the design of the gas exit flow profile, and thus barrel porosity, is important, and a method to facilitate design of one is provided hereinbelow.

In a preferred embodiment, passageways through a barrel wall are disposed along the barrel to maximize the projectile velocity for a gas driven gun. The driving gas source is in effect a chamber or reservoir containing high pressure gas. The driving gas can be selected from the group consisting of air, nitrogen, oxygen, carbon dioxide, combustion gases, hydrogen, helium, and plasma, for example. Other compressible fluid, such as a compressible liquid, can also be employed. The pressure chamber can be connected to a barrel, or projectile tube, by a passageway. The internal diameter of this passageway can be narrowing such that the most narrow location between the gas chamber and barrel is the barrel itself However, it may be acceptable for this passageway to have a narrower internal cross sectional area than the barrel. The barrel has a constant internal cross sectional area matching the projectile shape. The muzzle of the barrel, where the projectile will exit the barrel, opposite from the pressure chamber, is open ended. A projectile is placed in the breech of the barrel near the end that is connected to the pressure chamber. Upon firing the gun, either the projectile is held sealing the barrel and released with the full chamber pressure behind it, or gas is released from the pressure chamber to come in contact with the projectile. Passageways through the barrel wall for venting gas can begin near where driving gas immediately behind the projectile obtains local Mach 1 after the gun is triggered. From that location along the barrel and continuing to the muzzle end of the barrel, passageways through the barrel wall can be disposed along the barrel to cause a local gas mass flow out through the barrel wall that will accelerate driving gas immediately behind the projectile at an increasing supersonic magnitude that is equal to the projectile acceleration resulting from contact with driving gas pressure as it travels through the barrel. Barrel wall porosity can be varied by incorporating passageways through the barrel wall of various size and spacing along the barrel or using other types f porous material disposed along the barrel wall or using a barrel material of continuously varying porosity. The sonic limitation can be thereby overcome, and gas immediately behind the projectile, and the projectile itself obtain increasingly accelerating supersonic speed. A method to achieve such optimization of the propulsion process is described hereinbelow.

FIG. 1 shows one embodiment of a porous nozzle projectile barrel 26 with passageways such as passageway 20 through the wall of barrel 26. Barrel 26 is a barrel, tube, or any type of passageway through which projectile 18 may travel. Barrel 26 may be straight or curved in any shape and have any cross sectional area shape. Barrel 26 preferably has a porous region 14 extending from the location of first passageway 20 to muzzle 24 end where projectile 18 exits barrel 26. Barrel 26 preferably has a solid region 12 between breech 16 and location of first passageway 20. Barrel 26 contains at least one porous region 14 at any location along barrel 26 which preferably extends for the length of a substantial portion of the barrel. The porous region is preferably located downstream of the location where the projectile reaches Mach 1 and preferably extends for at least 20 percent of the length of the barrel, more preferably at least 30 percent of the length of the barrel, as measured between the breech end the muzzle end. A practical upper limit to the length of the porous region is in the range of about 60 to 90 percent of the length of the barrel. Preferably, none of the driving gas bleeds off along the first, i.e., subsonic, portion of the barrel and portions of the driving gas are bled off from a plurality of separate locations, e.g., two or more locations, for example, four or more locations, which are longitudinally spaced apart along the second portion of the barrel. The velocity of the projectile is subsonic in the solid region of the barrel and supersonic in the porous region of the barrel, as measured under local conditions immediately behind the projectile.

Projectile 18 is preferably placed near breech 16. The projectile preferably closely fits at least the first portion of the barrel. Projectile 18 is any object or matter that can be made to travel through barrel 26. A projectile in the form of a sphere, skirted pellet or bullet is highly suitable. A projectile constructed of lead, lead alloy, or copper jacket over lead core is highly suitable. Gas chamber 10 is connected to the end of barrel 26 at breech 16. Gas chamber 10 contains driving gas 38 which is used to propel projectile 18 through barrel 26.

Porous region 14 of barrel 26 contains at least one passageway 20 or other effective porosity extending partially or completely through barrel wall 28 that allows gas to flow out from or into barrel interior 22. Other effective passageways 20, or porosity, may include porous material, hollow cavities opening to barrel interior 22 of barrel 26, holes through barrel wall 28, or tubes connected through barrel wall 28. Slots or grooves in the barrel wall may also be effective. A barrel made of continuously varying porous material is another means of providing effective passageways 20. Valve 42 in communication with porous region 14 or passageway 20 may be used to control flow through porous region 14. In one embodiment, it is preferred that the interior wall of barrel 26 to be smooth, especially where supersonic driving gas 38 is achieved or exists.

Figure 2:
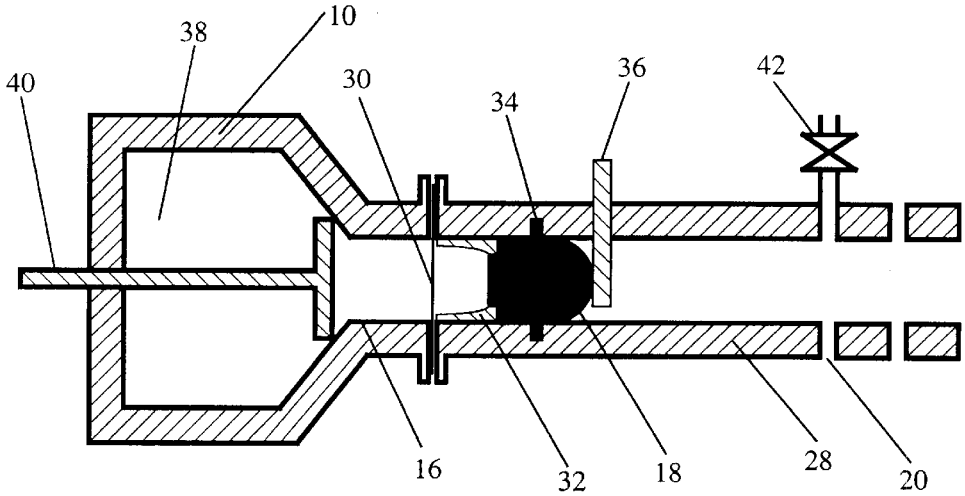
FIG. 2 shows projectile firing, sealing, pressure release, and trigger mechanisms that could be used in various combinations to allow pressurized driving gas to cause projectile acceleration upon firing a gun.

Solid region 12 of barrel 26 is preferably a solid tube with strength sufficient to hold driving gas 38 pressures. Breech 16 is connected to gas chamber 10, a passageway (not shown) leading to gas chamber 10, or a gas pressure source. Barrel 26 may be straight, curved, or formed in any shape that allows gas to flow therethrough. A straight barrel is preferred. The cross sectional area of barrel 26 and projectile 18 may be of any shape that allows projectile 18 to pass through barrel 26 when a force is applied to projectile 18. A circular cross section is preferred. Rupture disk 30 (FIG. 2) may be placed between gas chamber 10 and projectile 18 to rupture at a desired pressure in gas chamber 10. However, it is preferred to use other types of driving gas 38 release mechanisms that result in having no obstruction between driving gas 38 and projectile 18. A few examples of the driving gas release mechanisms that have no obstruction between driving gas 38 and projectile 18 are included hereinbelow.

Barrel 26 contains at least one porous region 14 and any number of solid regions 12 anywhere between breech 16 and muzzle 24. Barrel 26 porosity allows control of driving gas 38 pressure immediately behind projectile 18 and acceleration of projectile 18 along barrel 26. Injecting gas into barrel 26 through passageways 20 behind projectile 18 when the velocity of projectile 18 is subsonic increases driving gas 38 pressure immediately behind projectile 18 and can accelerate projectile 18 to sonic velocity quicker than without injecting gas. Placing passageways 20 allowing gas to exit from barrel interior 22 behind projectile 18 when projectile 18 is sonic or supersonic can accelerate projectile 18 and driving gas 38 immediately behind projectile 18 to supersonic velocities.

Various mechanisms may be used to initiate or facilitate projectile 18 acceleration. In a preferred embodiment, projectile 18 is placed in barrel 26 toward breech 16, or aft end of barrel 26. Projectile 18 may include obturating band 32 (FIG. 2) to maintain a seal between projectile 18 and barrel 26. Projectile 18 may also be held in place by a mechanical release 36 (FIG. 2) that releases projectile 18 at a desired time. Projectile 18 or surrounding barrel wall 28 may contain rupture rim 34 (FIG. 2) that seals between barrel 26 and projectile 18 and ruptures at a desired pressure in gas chamber 10. The rear end of projectile 18 may also include a shock absorbing device (not shown). Inlet valve 40 can be opened to release driving gas 38 so that it communicates with rupture disk 30 or projectile 18. A preferred embodiment may include but is not limited to the above mechanisms.

Gas chamber 10 contains a volume that holds driving gas 38 that propels projectile 18 through barrel 26. Gas chamber 10 is preferably a sufficiently large volume to maintain a relatively constant pressure as projectile 18 travels through barrel 26. Gas chamber 10 may be pressurized using an external gas reservoir (not shown). One example of an external gas reservoir is a SCUBA tank used to fill the gas chamber of the Beeman Mako airgun made by Beeman Precision Airguns, 5454 Argosy Drive, Huntington Beach, Calif. 92649 USA. Explosives (not shown) may also pressurize gas chamber 10. Driving gas 38 includes but is not limited to pressurized gasses such as hydrogen, air, nitrogen, carbon dioxide, or helium. Other suitable driving gasses include but are not limited to gasses formed from chemical reactions, explosives, gun powder, explosion products, plasma, or compressible substances that behave like a gas.

Barrel Porosity Optimization Method

In another embodiment of the invention, passageways 20 through barrel wall 28 can be disposed along barrel 26 to achieve an optimized driving gas 38 pressure profile along the path of projectile 18 as it travels through barrel 26. The primary driving gas 38 pressure of interest is the pressure of driving gas 38 immediately behind projectile 18 as projectile 18 travels through barrel 26. There are many methods to generate and analyze preferred embodiments including finite element methods, finite volume methods, Euler Equation schemes, water analogies, and others. The following is a method to optimize placement of passageways 20 along barrel 26 for the embodiment shown in FIG. 1 to obtain highest projectile 18 muzzle 24 velocity. This analytical model assumes isentropic, locally steady, driving gas 38 flow. Although this model is idealized, it is accurate and useful for preliminary design of an embodiment of a porous nozzle projectile barrel because it shows the limit of achievable gun performance and allows optimzation of design parameters through parametric sensitivity analysis.

Knowing driving gas 38 pressure applied to projectile 18 using isentropic gas flow equations, the acceleration of projectile 18 can be obtained from Newton's law, F=m·a. This leads to an iterative method to determine an optimal projectile 18 velocity profile along its path through barrel 26. This optimal velocity profile is equivalent to projectile 18 traveling through a supersonic nozzle designed to exactly conform the velocity of driving gas 38 to the velocity of projectile 18 at every location along the path of projectile 18 through barrel 26. Knowing the optimal projectile velocity profile, the required local driving gas 38 mass flux through barrel 26 can be obtained from isentropic equations. Knowing the local mass flux profile through barrel 26, the local mass flux that must exit barrel 26 through each passageway 20 can be determined. Porosity of the barrel wall can be arranged to achieve this mass flux that must exit through barrel porosity.

Driving gas 38 mass flow rate increases in barrel 26 until Mach 1 is reached. After Mach 1 is reached, any further increase in driving gas 38 velocity requires driving gas 38 expansion transverse to the gas flow direction. Since steady gas flow is limited to Mach 1 in a typical constant area gun barrel, porous region 14 allowing gas outflow is used to allow transverse expansion of driving gas 38. This allows driving gas 38 to achieve supersonic flow as if it had passed through a diverging nozzle. Assuming the gas flow is isentropic, a porous nozzle projectile barrel 26 can be designed and optimized using isentropic compressible gas flow relations as given in the following successive sections.

Variable Definitions

A=barrel 26 internal cross sectional area ($m^2$)
C=gas flow coefficient through passageway 20
D=passageway 20 diameter (m)
k=driving gas 38 specific heat ratio
L=barrel 26 length (m)
m=projectile 18 mass (kg)
$\dot{m}_b$=driving gas 38 mass flux through barrel 26 immediately behind projectile 18 (kg/s)
$\dot{m}_h$=sonic gas mass flux through passageway 20 (kg/s)
M=local driving gas 38 mach number
P=local driving gas 38 pressure ($N/m^2$)
$P_t$=stagnation pressure (gas chamber 10 pressure) ($N/m^2$)
R=driving gas 38 constant J/(Kg° K)
Δt=time increment (s)
T=local driving gas 38 temperature (° K)
$T_t$=stagnation temperature (gas chamber 10 temperature) (° K)
V=projectile 18 velocity or local driving gas 38 velocity (m/s)
$V_1$=projectile 18 velocity at beginning of computational time increment, Δt, (m/s)
$V_2$=projectile 18 velocity at end of computational time increment, Δt, (m/s)
X=projectile 18 position (distance from initial rest position) (m)

Method

Rearranging isentropic gas equations gives the following relations:

$$T = T_t - \frac{(k-1)V^2}{2kR} \tag{1}$$

$$M = \frac{V}{\sqrt{kRT}} \tag{2}$$

$$P = P_t\left(1 + \frac{(k-1)}{2}M^2\right)^{\left(\frac{k}{1-k}\right)} \tag{3}$$

Equations are from John, James E. A., 1984, *Gas Dynamics,* Allyn and Bacon, Inc., Newton, Mass.

The following steps are used to optimize porosity of barrel 26. Projectile 18 starts from rest at position X=0 m, near breech 16. Porosity begins at first passageway 20 and continues to muzzle 24. Porosity begins where projectile 18 and driving gas 38 velocity equal Mach 1. Friction between barrel 26 and projectile 18 is neglected here for simplicity, although it may be accounted for by subtracting the frictional force from the term P·A in step 4 below. Assuming driving gas 38 velocity at the location of projectile 18 equals the velocity of projectile 18, the following steps can be iterated with time to determine the optimum projectile 18 velocity profile at every X position along barrel 26:

1. Calculate temperature, T, of driving gas 38 at projectile 18 assuming the local driving gas 38 velocity equals the instantaneous velocity of projectile 18, V, using Eq. (1).
2. Calculate local Mach number, M, of driving gas 38 at projectile 18 using Eq. (2).
3. Calculate local pressure, P, of driving gas 38 at projectile 18 using Eq. (3).
4. Calculate new projectile 18 velocity, $V_2$, after time increment, $\Delta_t$, using $$V_2 = V_1 + \left(\frac{PA}{m}\right)\Delta t.$$

5. Integrate the average velocity, V, of projectile 18 with respect to time to determine the new position, X, of projectile 18 after time increment, $\Delta_t$.
6. Calculate optimal driving gas 38 mass flux through barrel 26 at projectile 18 using the relation $$\dot{m}_b = \frac{PAV}{RT}.$$

7. After projectile 18 and driving gas 38 reach Mach 1, the local mass outflow per barrel length required to cause optimal supersonic gas outflow through porous region 14 may be determined as $$-\frac{\Delta \dot{m}_b}{\Delta X}.$$

The difference in axial mass flux, $\dot{m}_b$, between any two points along porous region 14 of barrel 26 gives optimal gas outflow that must leave through passageway 20 such as a hole or other means of barrel porosity.

8. Eq. (4) can be used to determine mass outflow, $\dot{m}_h$, from passageway 20 (such as a hole, orifice, or pore) through barrel wall 28 with a given passageway 20 diameter, D.

Eq. (4) can be used with the above steps to provide passageway 20 size and spacing for an optimum design. It may be desired to solve Eq. (4) for passageway 20 diameter, D, since optimal mass outflow, $\dot{m}_h$, can be determined from step 7 in the above procedure. Eq. (4) should be solved for D to determine each passageway 20 diameter to give optimum mass outflow if passageway 20 spacing is predetermined. If passageway 20 size is predetermined, use Eq. (4) to determine the mass outflow, $\dot{m}_h$, through passageway 20 and space passageways 20 along porous region 14 according to the optimal mass outflow found in step 7.

$$\dot{m}_h = C\left(\frac{P}{RT}\right)\left(\frac{\pi D^2}{4}\right)\sqrt{kRT} \tag{4}$$

From John, James E. A., 1984, *Gas Dynamics,* Allyn and Bacon, Inc., Newton, Mass.

Steps 1 through 5 are repeated for each time increment, $\Delta_t$, to predict optimal projectile 18 velocity profile and driving gas 38 properties behind projectile 18 at every position along barrel 26. Steps 6 and 7 are used to determine the required mass outflow through passageways 20 that allows optimal transverse expansion of driving gas 38 within barrel 26 and causes optimal projectile 18 velocity. Knowing the optimal mass outflow along porous region 14, step 8 can be used to determine proper passageway 20 size and spacing along barrel 26. The flow coefficient, C, in Eq. (4), is generally a constant based on the efficiency of gas flow through passageways 20 through barrel wall 28. The flow coefficient, C, should be determined by experiment for a specific passageway 20 type to obtain best accuracy in the above calculation. Experiments may show that the flow coefficient, C, may vary with local driving gas 38 velocity along barrel 26. Methods such as using an effective passageway 20 diameter may be used if passageway 20 is not a circular hole.

While there have been described and illustrated several specific embodiments of the invention, it will be clear that variations in the details of the embodiments specifically illustrated and described may be made without departing from the true spirit of the invention as defined in the appended claims.

In the embodiment of the invention shown in FIG. 1, it can be seen that the porous section of the barrel increases in porosity from the breech toward the muzzle. In the illustrated embodiment, the porosity is increased by decreasing the spacing between the passageways 20; however, the result can also be provided by increasing the size of passageways 20 as the exit from the porous section is approached, or both passageway size can be increased and the spacing between passageways decreased. A barrel constructed in accordance with the FIG. 1 embodiment of the invention can thus be easily identified, as it will be characterized by a porous section having a plurality of longitudinally spaced apart passageways which provide an ever increasing outflow area per unit length going from the inlet to the outlet of the porous section. The porous section will generally constitute at least 10% of the total barrel length as measured from breech to muzzle, preferably at least 20% of the total length. Phrased another way, from beginning to end, each portion of the porous section of the barrel preferably provides an incremental increase in the amount of porosity per unit length over the previous portion. More preferably, the amount of porosity provided in each succeeding unit of length of the porous section smoothly increases in a stepwise fashion over the length of the porous section. The porous section begins in some intermediate section of the barrel where the velocity of the projectile has substantially reached Mach 1, preferably at the initial point at which the velocity of the projectile has substantially reached Mach 1, based on the speed of sound in the driving gas immediately behind the projectile.

What is claimed is:

1. Apparatus comprising:

a barrel formed by a barrel wall and having a breech end and a muzzle end, said barrel wall defining a passage of constant cross section extending from the breech end to the muzzle end;

a projectile having a cross section which closely matches the cross secton of the passage positioned in the passage; and a driving gas pressure source connected to the breech end of the barrel, said driving gas pressure source having a sufficiently high pressure to accelerate the projectile to local Mach 1 in said barrel;

wherein said barrel wall has a solid region extending from the breech end toward the muzzle end and a porous region, serially arranged, wherein said porous region is sufficiently permeable to the driving gas so that transverse expansion of the driving gas through the porous region permits the driving gas to achieve supersonic flow as if said driving gas had passed through a diverging supersonic nozzle, and provide a projectile velocity profile equivalent to the projectile traveling through a supersonic nozzle designed to exactly conform the velocity of driving gas to the velocity of the projectile at every location along the path of the projectile through the porous region, wherein the driving gas velocity is subsonic in the solid region of the barrel and supersonic in the porous region of the barrel.

2. Apparatus as in claim 1 wherein the porous region of the barrel extends for at least 20 percent of the length of the barrel as measured between the breech end and the muzzle end.

3. Apparatus as in claim 2 wherein the porous region of the barrel comprises a plurality of longitudinally spaced apart transverse passageways extending through the barrel wall to cause a plurality of local gas mass flows from the passage and out through the barrel wall to achieve supersonic gas flow within said barrel and increasing speeds substantially greater than the speed of sound in driving gas flow within said barrel.

4. Apparatus as in claim 3 wherein the projectile has a cross section which closely matches the cross section of the passage and forms a seal against the barrel wall form the breech end and the plurality of longitudinally spaced apart passageways provide an ever increasing outflow area per unit length along the porous region of the tube, wherein the driving gas velocity is sub sonic in the solid region of the barrel and supersonic in the porous region of the barrel.

* * * * *